US005355878A

United States Patent [19]

Griffiths et al.

[11] Patent Number: 5,355,878

[45] Date of Patent: Oct. 18, 1994

[54] BREATHING EQUIPMENT FOR AIRCREW

[75] Inventors: Joseph A. Griffiths, Haslemere; Donald M. Smeaton, Brighton, both of England

[73] Assignee: Cam Lock (UK) Ltd., Farnborough Hants., England

[21] Appl. No.: 958,108

[22] PCT Filed: Jun. 26, 1991

[86] PCT No.: PCT/GB91/01034

§ 371 Date: Feb. 22, 1993

§ 102(e) Date: Feb. 22, 1993

[87] PCT Pub. No.: WO92/00120

PCT Pub. Date: Jan. 9, 1992

[30] Foreign Application Priority Data

Jun. 26, 1990 [GB] United Kingdom ..... 9014212
May 22, 1991 [GB] United Kingdom ..... 9111070

[51] Int. Cl.[5] ..... A62B 18/02

[52] U.S. Cl. ..... 128/206.24; 128/205.25; 128/202.11; 128/201.23; 2/2.14; 600/20

[58] Field of Search ..... 600/19, 20; 128/205.25, 128/206.21, 206.23, 206.24, 206.28, 207.11, 202.11, 201.23, 201.22, 201.24; 2/2.14, 2.11

[56] References Cited

U.S. PATENT DOCUMENTS

| | | | |
|---|---|---|---|
| 2,348,108 | 9/1941 | Bulbulian | 128/201.13 |
| 2,827,900 | 3/1958 | Marietta | 128/207.11 X |
| 3,330,274 | 7/1967 | Bennett | 128/206.26 |
| 3,513,841 | 5/1970 | Seeler | 128/201.13 |
| 3,695,264 | 10/1972 | Laeral | 128/206.28 X |
| 3,833,935 | 9/1974 | Ansite et al. | 2/6.2 |
| 3,910,269 | 10/1975 | Ansite et al. | 128/201.24 |
| 5,219,368 | 6/1993 | Page | 2/413 |

FOREIGN PATENT DOCUMENTS

| | | | |
|---|---|---|---|
| 1317654 | 1/1963 | France | 128/206.21 |
| 2375873 | 9/1978 | France | 128/201.24 |
| 2657264 | 7/1991 | France . | |
| 826198 | 12/1959 | United Kingdom . | |
| 2080120 | 2/1982 | United Kingdom | 128/206.21 |

*Primary Examiner*—Edgar S. Burr
*Assistant Examiner*—Eric P. Raciti
*Attorney, Agent, or Firm*—Dilworth & Barrese

[57] ABSTRACT

A facemask incorporating breathing equipment for use with a flying helmet (2) comprises a rigid outer shell (4) in which a flexible face-piece (3) is housed whose periphery makes an airtight seal with the pilot's face (1). The face-piece (3) includes an inhalatory valve (11) and an expiratory valve (9) and the rigid shell (4) is attached to the helmet (2) by a harness (5) which keeps the shell (4) at a fixed distance from the helmet (2). Inflatable means (15, 20) are provided between the shell (4) which are inflated to press the periphery (14) of the face-piece towards the pilot's face when the pressure of breathable gas supplied to the interior of the mask and to said inflatable means increases above that required for normal breathing. Alternatively, the face-piece (3) can include extendable means in the form of a re-entrant section (30, 34, 35) or bellows section (36) which extends in a direction towards the pilot's face when the pressure of the breathable gas supplied to the interior of the face-piece (3)increases above that required for normal breathing.

18 Claims, 5 Drawing Sheets

FIG. 1.
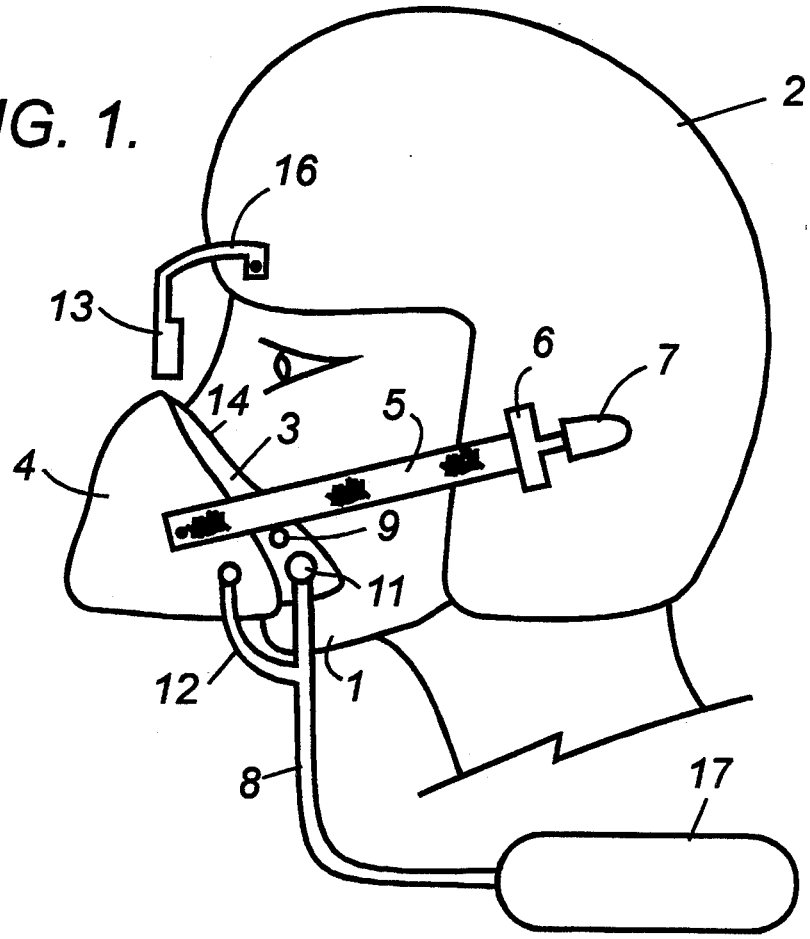
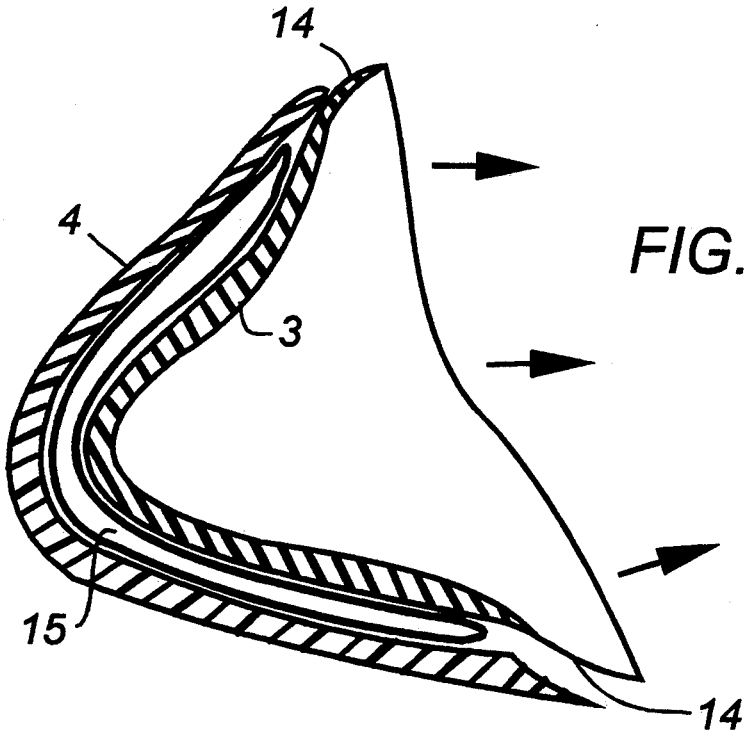
FIG. 2.

FIG. 3.
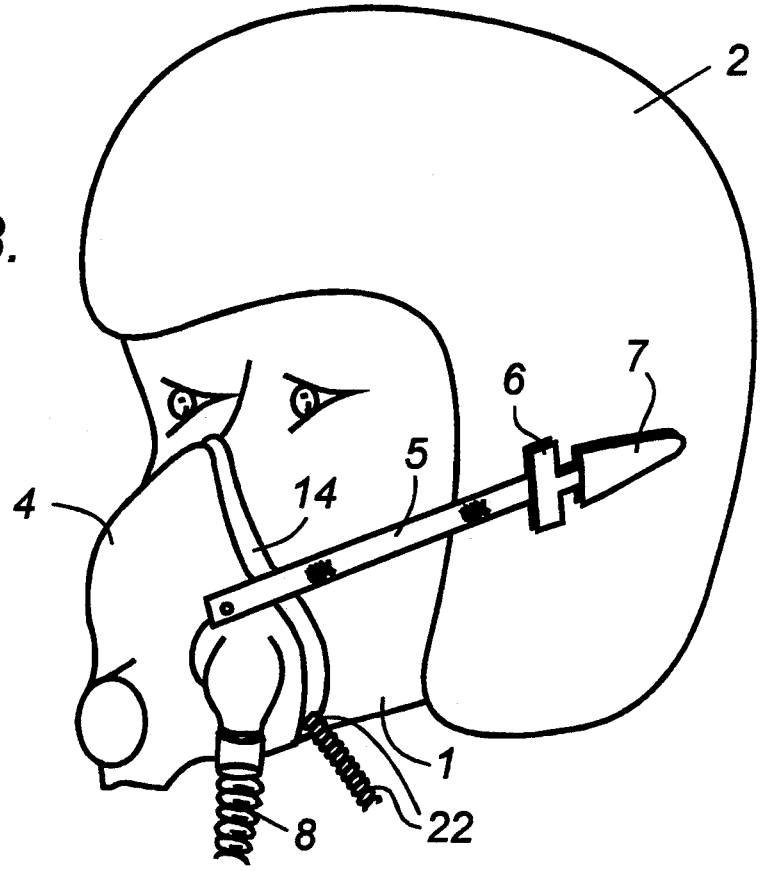
FIG. 4.
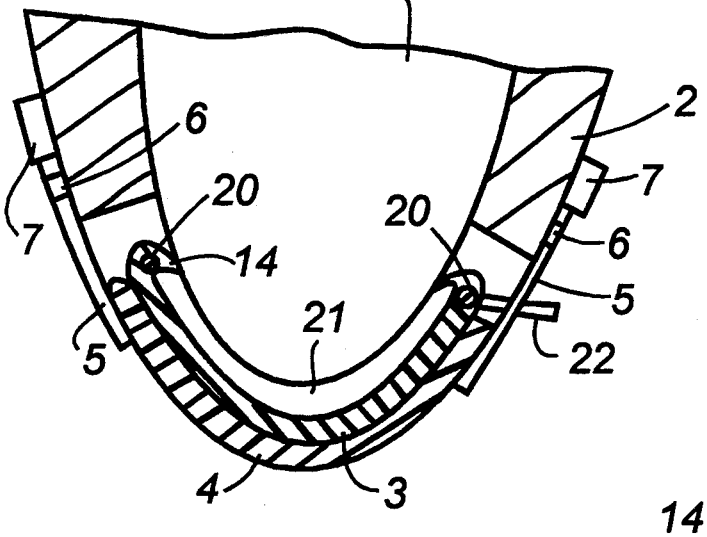
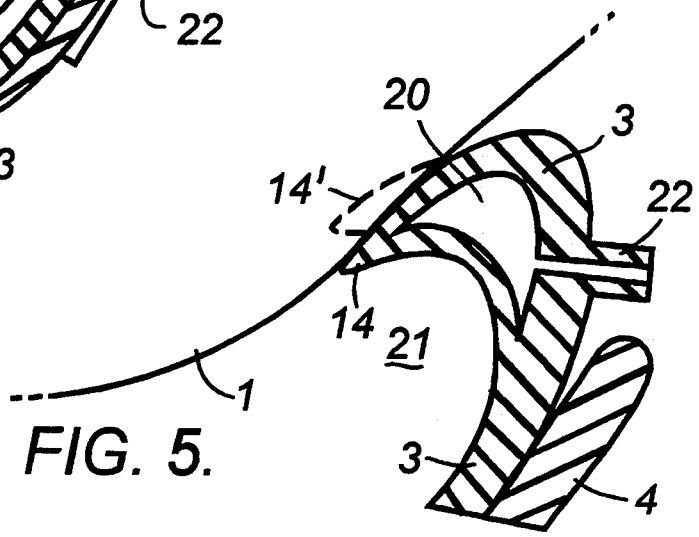
FIG. 5.

BREATHING EQUIPMENT FOR AIRCREW

BACKGROUND OF THE INVENTION

1. Field of the Invention

This invention relates to breathing equipment for aircrew.

2. Description of the Related Art

The normal breathing equipment for aircrew comprises a flexible face mask having an inspiratory valve supplied with oxygen or some other breathable gas and an expiratory valve to allow the pilot to expel the air from the mask on exhalation. The face mask is attached to the pilot's helmet by means of a harness incorporating a releasable fitting.

In fighter aircraft, it is necessary that the face mask makes a proper seal with the pilot's face at all times. Under normal flying conditions, this is not a problem as the pilot adjusts the harness tension so that it makes the necessary seal and is also comfortable to wear. The supply of the breathable mixture through the mask is controlled by a breathing gas regulator which is responsive to the G-forces that it is subject to. In other words, when the G-force increases, the pressure of the gas supply is correspondingly increased and vice versa. Thus, changes in the G-forces applied to the regulator controlling the breathable gas supply result in automatic changes in pressure in the interior of the mask. It will be appreciated that unless some suitable means are provided to improve the seal between the mask and the pilot's face, any increase in pressure within the mask cavity will cause the mask seal to leak to atmosphere so the pilot will not receive the pressure of breathable gas he requires and could black-out. This condition will be critical, particularly in a combat situation.

One known way of overcoming this problem has been to provide an over-centre toggle in the harness assembly attaching the mask to the helmet. The over-centre toggle is in its non-tensioned position for normal flight but, when the pilot wants to make a tight turn, he moves the toggle into its tensioned position before he makes the turn thereby increasing the tension on the face mask and improving its seal on his face. After the turn is completed, the pilot then releases the toggle. Indeed he has to do this because the pressure exerted on his face when the toggle is engaged is so great that it is very uncomfortable. The main problem with this arrangement is that the pilot has to remember to engage the toggle before he makes a turn (possibly difficult in a combat situation). Furthermore, he must release the toggle after the turn as the pressure on his face is too high to be comfortable for normal flying.

In another known solution, the problem of the pilot having to normally tension the toggle on the facemask each time he makes a turn is overcome by connecting the facemask inlet hose, supplied by the regulator to a bladder situated in the pilot's helmet between the back of his head and the inside of the helmet. With this arrangement, when the regulator automatically increases the breathable gas pressure to the facemask, the bladder is inflated and pushes the rear of the helmet away from the rear of the pilot's head.

Because the breathing mask is attached to the helmet by means of the harness arrangement which is inextensible, the breathing mask is drawn towards the pilot's face thereby increasing its sealing capability and coping with the increased pressure of the gas supplied to the interior of the mask. After the turn has been completed, the regulator automatically reduces the gas supply pressure so the bladder is correspondingly deflated and the increased mask pressure on the pilot's face is reduced accordingly. Thus, it will be appreciated that with this system, automatic adjustment of the pressure exerted by the mask on the pilot's face is achieved, this pressure being dependent on the G-forces generated by the aeroplane during flight which are sensed by the regulator controlling the breathable gas supply.

Whilst it might appear that a helmet incorporating a bladder provides an excellent solution to the problem of continually adjusting the pressure of the mask on the pilot's face, there is a serious problem with this arrangement because fighter pilots in the future will have avionic systems attached to their helmets incorporating an armament sight which the pilot has to look through in order to direct his fire power on the target. This sight normally comprises an arm or the like attached to the helmet and extending forwardly therefrom into the pilot's line of vision. Thus, everytime the pilot's helmet moves, the sight will also move. It will be appreciated therefore that such a sighting system cannot be satisfactorily used with a breathing system which necessitates the helmet to move to improve the sealing of the facemask on the pilot's face as the sight will not work accurately. Thus, avionic systems cannot be used effectively with a helmet of this type.

It is therefore an object of the present invention to provide an improved facemask for use with an aircrew flying helmet which overcomes or substantially reduces the problems of the prior art by causing the face-piece to which the breathable gas is supplied rather than the pilot's helmet to be moved towards the pilot's face and thus increase the seal therewith when the pressure of the breathable gas supplied to the interior of the mask increases above that required for normal breathing and vice versa. By keeping the pilot's helmet stationary at all times and dynamically moving the facemask in relation thereto, avionic systems can be attached to the helmet which will work satisfactorily.

SUMMARY OF THE INVENTION

According to the invention, there is provided a facemask incorporating breathing equipment for use with an aircrew flying helmet comprising a rigid outer shell in which a flexible face-piece is received whose periphery is adapted to make a seal with the pilot's face, the face-piece incorporating an inspiratory and expiratory valve and the outer shell having means for attaching it at a fixed distance from the helmet, the face-piece further including extendable means automatically operable to press the periphery of the face-piece towards the pilot's face to improve the seal therewith when gas at a pressure above that required for normal breathing is supplied to the facemask and the extendable means reconfigure as a result thereof.

The extendable means can comprise inflatable means such as an inflatable bladder located between the shell and the face-piece which is operable to move the whole of the face-piece on inflation, away from the shell and towards the pilot's face to improve the seal therewith at the periphery thereof and vice versa.

Alternatively, the inflatable means can take the form of an inflatable chamber provided in the periphery of the flexible face-piece where it makes its seal with the pilot's face.

In one preferred embodiment, the periphery of the face-piece is substantially C-shaped in cross section to provide an edge sealing lip which faces towards the rigid outer shell, the inflatable chamber being provided in said C-shaped periphery.

In another embodiment, the inflatable means comprises a chamber provided in the face-piece between the front and the edge periphery thereof, said chamber on inflation being reconfigured as a result of which the periphery is moved towards the pilot's face and vice versa.

In the aforementioned arrangements, the inflatable means are inflated by gas supplied from the breathable gas supply connected thereto. However, the invention also provides arrangements where the extendable means are not actually inflated by the breathable gas but instead the face-piece incorporates an extendable section in its wall which reconfigures and extends when the breathable gas is supplied to the interior of the face-piece with the result that the edge region of the face-piece is pressed against the pilot's face with an increased pressure.

The extendable means can comprise a re-entrant section in the wall of the face-piece or it can take the form of a bellows section or a convoluted rolling section whose wall thickness is less than that of the remainder of the face-piece wall. In this latter embodiment, the convoluted rolling section is preferably generally S-shaped in cross-section.

For the extendable means to work properly and move the periphery of the face-piece into better contact with the pilot's face, radial or lateral movement or expansion of the face-piece wall needs to be restricted. It is therefore preferably wholly contained within the rigid outer shell. It could however work satisfactorily if it was only partially within said shell.

When the improved breathing mask of the present invention is attached to a pilot's flying helmet, for instance using a known harness arrangement, the rigid outer shell will not be movable in a direction away from the front of the helmet. As the extendable means are actuated by the breathable gas supply controlled by a known regulator, they will be inflated and deflated or extended or contacted dependent on the increase or decrease in the breathable gas supply. Thus an increase in pressure within the face piece can only result in it being pushed further towards the pilot's face to increase the pressure thereon and thus the seal. If however there is a decrease in the gas supply, the mask will move away from the pilot's face by a corresponding amount and the pressure thereon will be reduced.

It will be appreciated from the foregoing that the helmet does not move in relation to the pilot's head during any of the movements of the face-piece so avionic equipment can be mounted on the helmet and will work perfectly satisfactorily.

BRIEF DESCRIPTION OF THE DRAWINGS

Preferred embodiments of the invention will now be described, by way of example only with reference to the accompanying diagrammatic drawings in which:

FIG. 1 is a side view of one form of facemask of the present invention illustrated in use with an aircrew helmet and a breathable gas supply;

FIG. 2 is a cross-section through the facemask shown in FIG. 1;

FIG. 3 is a perspective view of another form of facemask of the invention;

FIG. 4 is a plan view in cross-section of the facemask shown in FIG. 3 with some parts omitted for ease of illustration;

FIG. 5 is a scrap view of a part of the facemask shown in FIG. 4;

DESCRIPTION OF THE PREFERRED EMBODIMENTS

Figure 6:
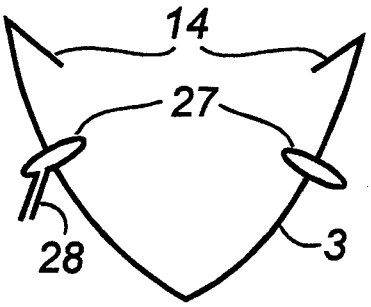
FIG. 6 is a schematic view of another type of face-piece for use with a facemask of the present invention.
Figure 6A:
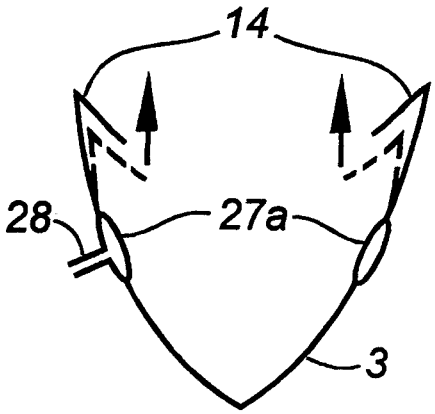
Figure 7:
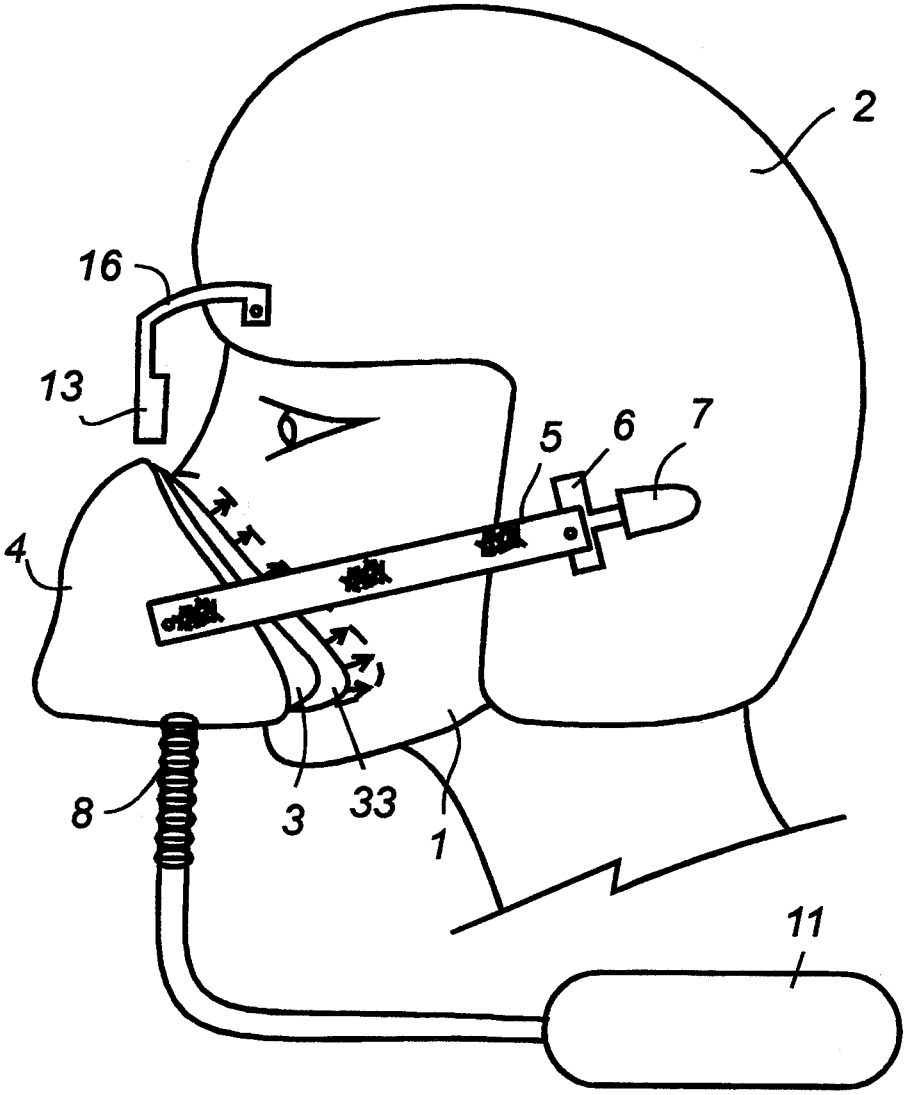
FIG. 7 is a side view of an alternative facemask of the present invention illustrated in use with an aircrew helmet and a breathable gas supply.

Referring now to the drawings, FIG. 1 shows a pilot 1 wearing a rigid protective helmet 2. A flexible breathing face-piece 3, usually made of natural or synthetic rubber, surrounds the pilot's nose and mouth and is mounted in a rigid plastic shell 4 attached to the helmet 2 by means of a harness arrangement 5 having a fitting 6 at one end to releasably attach it to a fitting part 7 mounted on the helmet. The harness 5 includes adjustable means (not shown) so that its length can readily be adjusted to ensure that the face-piece 3 rests comfortably on the pilot's face with its edge lip 14 making a proper seal with the area of the pilot's face surrounding his nose and mouth. An avionic armament sight 13 is mounted on an arm 16 attached to the helmet 2, and protrudes forwardly therefrom into the pilot's line of vision as illustrated.

Breathable gas such as oxygen is supplied to the interior of the face-piece 3 from a pressurized gas supply 17 connected to an inlet 11 by means of a hose 8 and controlled by a regulator (not shown). A secondary inlet hose 12 connects the gas inlet hose 8 to an inflatable bladder 15 (see FIG. 2) located between the rigid shell 4 and the face-piece 3. An exhalatory valve 9 is also provided in the face-piece 3.

The operation of the illustrated arrangement is as follows:

In normal flight where no G-forces are exerted on the aircraft, breathable gas is supplied from the pressurized supply 17 via inlet hose 8 to the interior of the face-piece 3 fitted over the pilot's nose and mouth. As soon as the pilot makes a turn, this will generate G-forces which will affect the regulator (not shown) which in turn will increase the pressure of the gas supplied from the source 17 to the face-piece 3. The bladder 15 will therefore be correspondingly inflated by the increased gas pressure supplied to its interior via the secondary supply hose 12. As the rigid shell 4 cannot move relative to the helmet 2 because its position in relation thereto is controlled by the harness 5 which is of fixed length, inflation of the bladder 15 will push the face-piece 3 the helmet 2 as indicated by the arrows in FIG. 2. This movement effectively increases the seal of the face-piece 3 on the pilot's face. Reductions in the gas supply pressure cause the bladder 15 to deflate accordingly and thus to reduce the pressure of the face-piece 3 on the pilot's face.

It will be appreciated that during flight, the aeroplane will be making many turns and the G-forces generated will therefore vary considerably. The regulator (not shown) which controls the gas supply from the source 17 in combination with the inflation and deflation of the bladder 15 therefore ensures that the face-piece 3 can be kept in contact with the pilot's face at the required pressure.

Since it is the face-piece 3 which is moving relative to the pilot's face to increase or decrease its seal therewith, the helmet 2 remains stationary at all times so the avionics sight 13 can be attached to it and will work perfectly satisfactory regardless of the G-forces to which the pilot or the aircraft is being subjected.

Referring now to the arrangement shown in FIGS. 3–5, it can be seen that the facemask comprises a rigid shell 4 in which a flexible face-piece 3 is received which is provided with an inlet 8 supplied with a breathable gas mixture, the supply pressure of which is controlled by a first regulator (not shown) in the manner already described.

The periphery of the face-piece 3 (see FIG. 4) is shaped to include a lip seal 14 which presses against the pilot's face 1 to make a seal therewith. The interior of the lip seal 14 is moulded so as to be hollow and provide pneumatic chamber 20 extending along the length thereof. The interior of the chamber 20 is connected by pipe 22 to a separate gas supply (not shown) controlled by a second regulator (not shown) whereby gas from said separate gas supply is fed to the interior of the pneumatic chamber 20 at a pressure slightly higher than that supplied via inlet 8 to the interior 21 of the face-piece 3.

The operation of the illustrated system is as follows: Gas is supplied to the interior 21 of the face-piece 3 through the gas inlet 8 controlled by the first regulator (not shown) in the usual way. However, as the G-forces increase and decrease during flight, the second regulator controls the supply of gas from the separate gas supply to the interior of the pneumatic chamber 20 via inlet 22 so that it is fed thereto at a pressure above that supplied to the interior 21 of the face-piece 3 so the chamber 20 is inflated and the edge seal 14 moves to the alternative position 14' indicated in FIG. 5. It can be seen therefore that the pressure applied by the edge seal 14 on the pilot's face increases automatically if the gas supply thereto increases under the control of the second regulator (not shown) and vice versa. This is because the only direction the edge seal 14 can move on inflation of the chamber 20 is towards the pilot's face as the shell 4 is fixed and cannot move relative to the helmet 2 because of the restraint therein by the harness 5.

In the arrangement shown in FIG. 6, face-piece 3 incorporates a chamber 27 which is supplied via inlet 28 with a separate gas supply (not shown) to that supplied to the interior of the face-piece 3. The gas supply to the chamber 27 also has to be at a pressure higher than that supplied to the interior of the face-piece 3 otherwise it will not be inflated and assume the illustrated configuration **27*a* in which the edge seal 14** is moved in the direction of the arrows towards the pilot's face.

Referring now to FIGS. 7–12 of the drawings, as with the previously described embodiments there is shown a pilot 1 wearing a rigid protective helmet 2. A flexible breathing face-piece 3, usually made of natural or synthetic rubber, surrounds the pilot's nose and mouth and is mounted in a rigid plastic shell 4 attached to the helmet 2 by means of harness arrangement 5 having fitting 6 at one end to releasably attach it to fitting part 7 mounted on the helmet. The harness 5 includes adjustable means (not shown) so that its length can be readily altered to ensure that the face-piece 3 rests comfortably on the pilot's face with its edge lip 33 making a proper seal with the area of the pilot's face surrounding his nose and mouth. An avionic armament sight 13 is mounted on arm 16 attached to the helmet 2 to protrude forwardly therefrom into the line of vision as illustrated.

Breathing gas such as oxygen is supplied to the interior of the face-piece 3 from an oxygen regulator (not shown) connected thereto by means of a hose 8.

An expiratory valve (not shown) is also provided in the face-piece 3.

Figure 8:
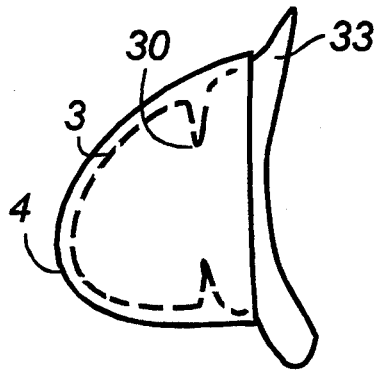
FIG. 8 is a schematic view, on an enlarged scale, of part of the facemask shown in FIG. 7 in its normal condition and extended conditions; and, FIGS. 9–12 illustrate schematically various alternative flexible face-pieces in their normal and extended conditions.
Figure 8A:
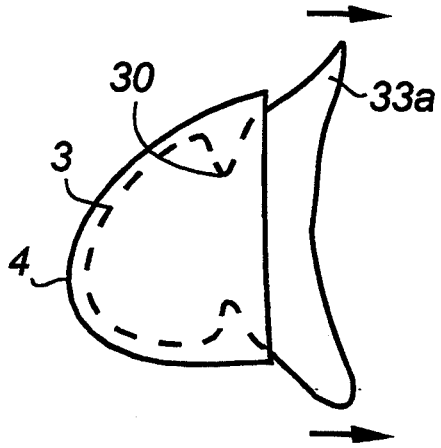

As can be seen more clearly in FIG. 8, the wall of the face-piece 3 includes extendable means 30 which are housed within the rigid shell 4. The purpose of the extendable means 30 is to enable the edge seal 33 to move in a direction generally parallel to the wall of the rigid shell 4 when the pressure supplied to the interior of the face-piece 3 is increased as a result of the regulator (not shown) being activated when the aircraft makes a turn. When the pressure supplied to the interior of the face-piece 3 increases, its wall expands to cope with the increased pressure. As the wall cannot move radially outwardly because it is contained within the rigid shell 4, it can only move in a direction generally towards the pilot's face in the direction of the arrows and thereby improves its seal therewith.

FIGS. 9–12 illustrate several different types of flexible face-piece 3 which incorporate alternative forms of extendable means. In each of these embodiments it is the breathable gas supply to the interior of the face piece 3 at its constantly changing pressure which causes the extendable means to extend/expand or contract.

Figure 9:
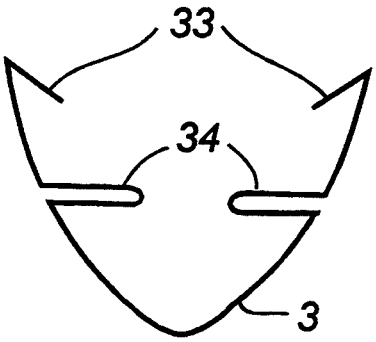
Figure 9A:
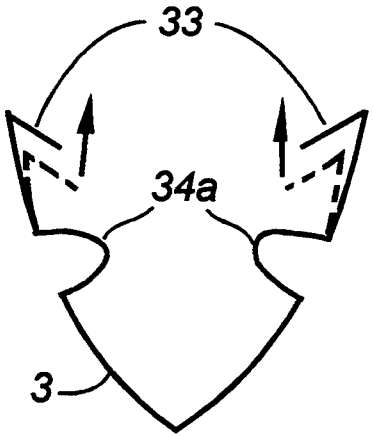

In the arrangement shown in FIG. 9, the wall of the face-piece 3 includes a re-entrant section 34 which opens up or extends on pressurisation of the interior of the face-piece 3 to reconfigure into the profile **34*a* whereby the edge region 33** shown in dotted line moves in the direction of the arrows into the position shown in full line.

Figure 10:
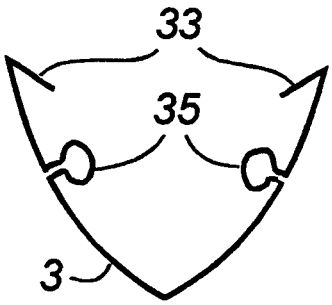
Figure 10A:
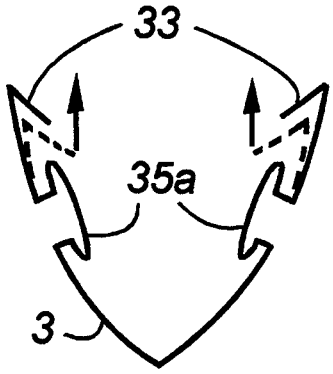

The face-piece 3 shown in FIG. 10 is similar to that shown in FIG. 9 except that the re-entrant sections 35 include a generally circular portion in cross-section and reconfigure on inflation of the interior of the face-piece 3 into the profile **35*a* whereby the edge region 33** shown in dotted line moves in the direction of the arrows into the position shown in full line.

Figure 11:
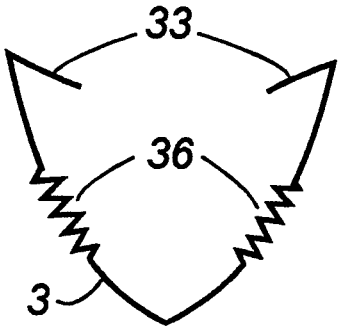
Figure 11A:
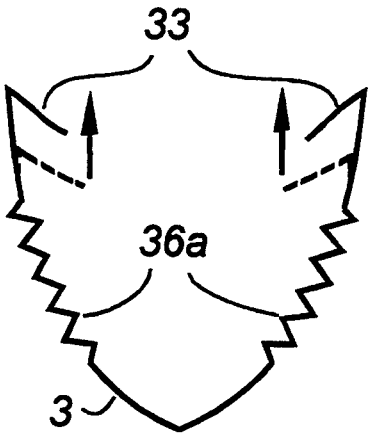

FIG. 11 shows yet another face-piece configuration in which it incorporates a bollows section 36 which extends into configuration **36*a* and causes the edge region 33** to move towards the pilot's face.

Figure 12:
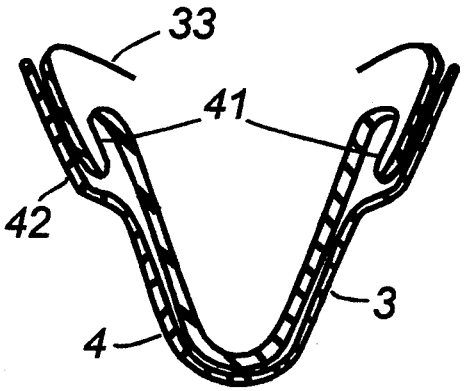
Figure 12A:
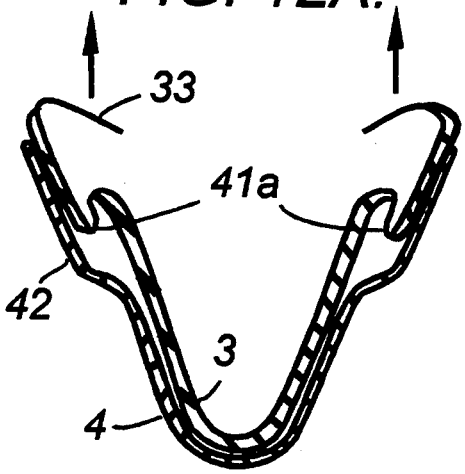

In the arrangement shown in FIG. 12, the face-piece 3 is housed within the rigid shell 4 as has already been described. The face-piece 3 is manufactured with a convoluted rolling section 41 situated behind and adjacent the edge seal 33 and accommodated in an enlarged section 42 of the rigid shell 4.

As can be seen from the drawings, the thickness of the wall of the face-piece 3 in the region of the convoluted rolling section 41 is thinner than the remainder of the face-piece 3 thereby allowing it to be rolled back on itself into the S-shaped configuration illustrated.

In its normal state, the face-piece 3 is contained within the shell enlargement 42. However, when the pressure of the gas supply to the interior of the face-piece 3 is increased, the convoluted rolling section 41 tends to unroll and the edge seal 33 is moved in the direction of the arrows thereby increasing the force applied by the edge seal 33 to the pilot's face thus preventing leakage.

It will be seen from the foregoing description that the invention provides a simple dynamic system which adjusts the pressure of the face-piece 3 on the pilot's face automatically in response to the regulator controlled breathable gas supply pressure. As it is the face-piece 3 which moves rather than the helmet 2 or the shell 4, avionic systems can be mounted on the helmet.

We claim:

1. A facemask incorporating breathing equipment for use with an aircrew flying helmet comprising a rigid outer shell and a flexible face-piece, said flexible face-piece having a periphery adapted to make a seal with a pilot's face, the face-piece incorporating an inspiratory and expiratory valve and the outer shell having means for attaching said outer shell at a fixed distance from the helmet, and extendable means located between the rigid shell and the face-piece, said extendable means to selectively press the periphery of the face-piece towards the pilot's face to improve the seal therewith and means automatically operable in response to gas at a pressure above that required for normal breathing to reconfigure the extendable means to press the periphery of the face-piece toward the pilot's face.

2. A facemask as claimed in claim 1 wherein the extendable means comprises inflatable means.

3. The facemask as claimed in claim 2 wherein the face-piece has a front portion, and the inflatable means comprises a separate bladder located between the shell and the front portion of said face-piece, said inflatable means further for selectively moving the face-piece as a unit upon inflation away from the shell and toward a pilot's face to selectively improve and relax the seal therewith at the periphery of the mask.

4. A facemask as claimed in claim 2 wherein the inflatable means is connected to a breathable gas supply and the inflatable means is inflated by gas supplied from the breathable gas supply.

5. A facemask incorporating breathing equipment for use with an aircrew flying helmet comprising a rigid outer shell having a flexible face-piece received therein, said flexible face-piece having a periphery adapted to make a seal with a pilot's face, the face-piece incorporating an inspiratory and expiratory valve and the outer shell having means for attaching said outer shell at a fixed distance from the helmet, the face-piece further including extendable means to selectively press the periphery of the face-piece towards the pilot's face to improve the seal therewith and means automatically operable in response to gas at a pressure above that required for normal breathing to reconfigure the extendable means to press the periphery of the face-piece toward the pilot's face.

6. A facemask as claimed in claim 5 wherein the extendable means comprises inflatable means.

7. A facemask as claimed in claim 6 wherein the inflatable means comprises a chamber disposed around the peripheral of the face-piece, said chamber for selectively moving the periphery upon inflation towards the pilot's face to improve and relax the seal therewith at the periphery of the mask.

8. A facemask as claimed in claim 6 wherein the face-piece includes a front portion and the inflatable means includes a chamber disposed between the front portion and the periphery of the face-piece for selectively moving the periphery upon inflation toward the pilot's face to improve and relax the seal therewith at the periphery of the mask.

9. A facemask as claimed in claim 7 wherein the inflatable means is connected to a separate gas supply and said inflatable means is inflated by gas supplied from the separate gas supply.

10. A facemask as claimed in claim 5 wherein the face-piece includes a wall being disposed behind the rigid outer shell and the extendable means comprises an extendable section in the wall of the face-piece.

11. A facemask as claimed in claim 10 wherein the extendable means comprises a re-entrant section in the wall of the face-piece.

12. A facemask as claimed in claim 10 wherein the extendable means comprises a bellows section in the wall of the face-piece.

13. A facemask as claimed in claim 10 wherein the extendable section comprises a convoluted rolling section formed in the wall of the face-piece.

14. A facemask as claimed in claim 13 wherein the thickness of the wall of the convoluted rolling section is less than that of the remainder of the face-piece wall.

15. A facemask as claimed in claim 10 wherein the extendable section is located wholly behind the rigid outer shell.

16. A facemask as claimed in claim 1, wherein the means for attaching the rigid shell to the helmet is a harness which retains the rigid shell in a fixed position relative to the helmet.

17. A facemask as claimed in claim 5, wherein the means for attaching the rigid shell to the helmet is a harness which retains the rigid shell in a fixed position relative to the helmet.

18. A breathing system for a pilot comprising a facemask, a regulator operatively connected to a pressurized breathable gas supply, the facemask comprising a rigid outer shell having a face-piece to cover a pilot's nose and mouth, means for selectively connecting said shell to a flying helmet at a fixed distance therefrom, and extendable means for selectively moving the periphery of the mask toward a pilot's face to selectively improve and relax the seal therewith, said extendable means automatically operable in response to gas supplied at a pressure above that required for normal breathing to reconfigure the extendable means to press the periphery of the face-piece toward the pilot's face.

* * * * *